US005820481A

United States Patent [19]

Raudman

[11] Patent Number: 5,820,481

[45] Date of Patent: Oct. 13, 1998

[54] GOLF PUTTER

[76] Inventor: Charles J. Raudman, 877 Peri Ct., Redding, Calif. 96001

[21] Appl. No.: 588,878

[22] Filed: Jan. 19, 1996

[51] Int. Cl.[6] ..... A63B 53/04

[52] U.S. Cl. ..... 473/313; 473/332; 473/340

[58] Field of Search ..... 473/340, 341, 473/346, 347, 313, 314, 337, 305, 327, 339, 331, 332

[56] References Cited

U.S. PATENT DOCUMENTS

| | | | |
|---|---|---|---|
| 234,962 | 4/1880 | Swash | 473/340 |
| 235,668 | 7/1880 | Swash | 473/340 |
| D. 247,585 | 3/1978 | Duclos | 473/340 |
| 3,448,981 | 6/1969 | Anweiler | 473/314 |
| 3,547,445 | 12/1970 | Hardesty | 473/342 |
| 3,884,468 | 5/1975 | Cook | 473/340 |
| 3,966,210 | 6/1976 | Rozmus | 473/341 |
| 4,222,566 | 9/1980 | Berry | 473/252 |
| 5,014,992 | 5/1991 | McCallister | 473/340 |
| 5,160,141 | 11/1992 | Crews | 473/340 |
| 5,346,219 | 9/1994 | Pehoski | 473/329 |

*Primary Examiner*—Sebastiano Passaniti
*Assistant Examiner*—Stephen L. Blau
*Attorney, Agent, or Firm*—Coudert Brothers

[57] ABSTRACT

The present invention defines an improved golf putter employing an elastomeric material between the putter face and body to dampen vibrations caused by impact of the moving putter face on a golf ball, the vibrations being directed by the putter body configuration in such a way as to maximize the dampening function. With a double bend in the putter shaft to located the line of impact with the center of rotation of the head, the design further improves feel and stroke through face bottom weighting. Angular design of the face, bottom and heel acts to decrease potential blade turf drag, enhancing the smooth feel of the club system.

10 Claims, 6 Drawing Sheets

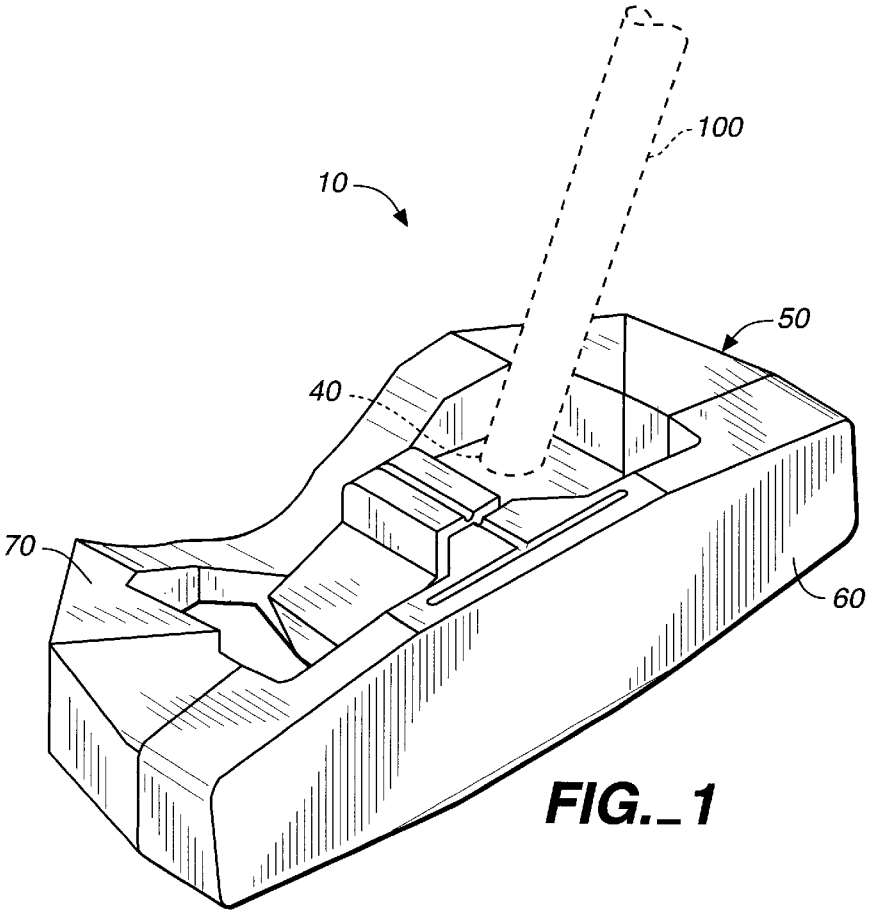
FIG._1
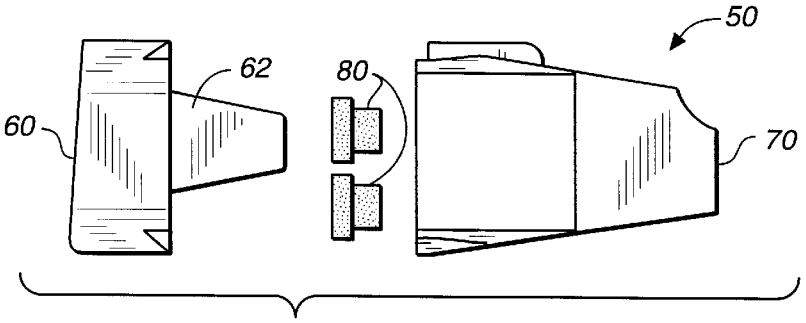
FIG._5
FIG._5A
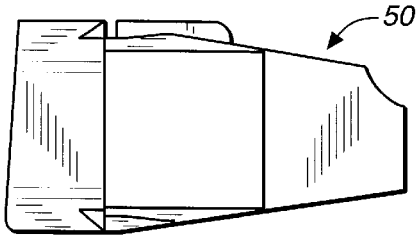

FIG._1A
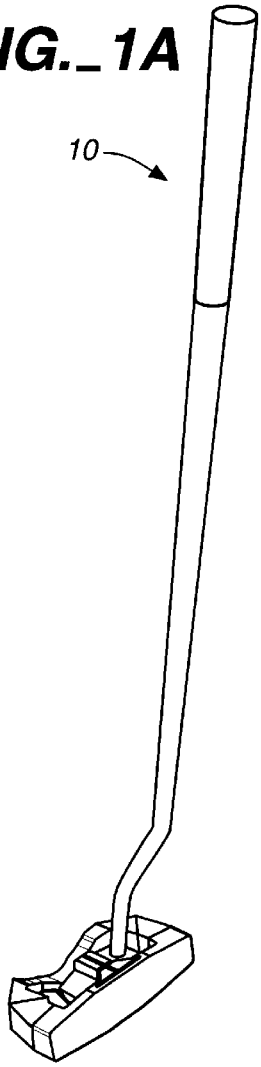
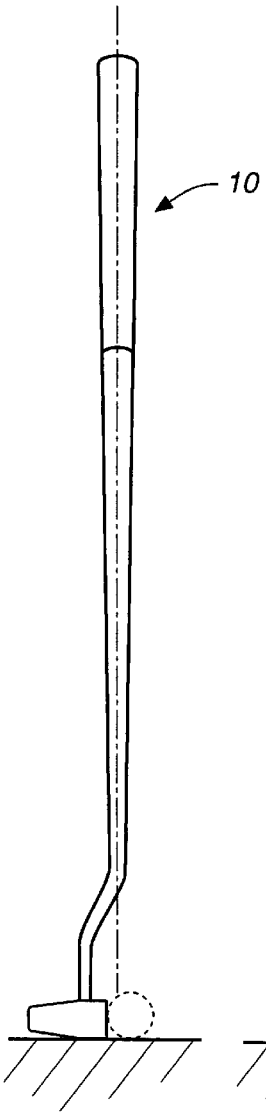
FIG._1B
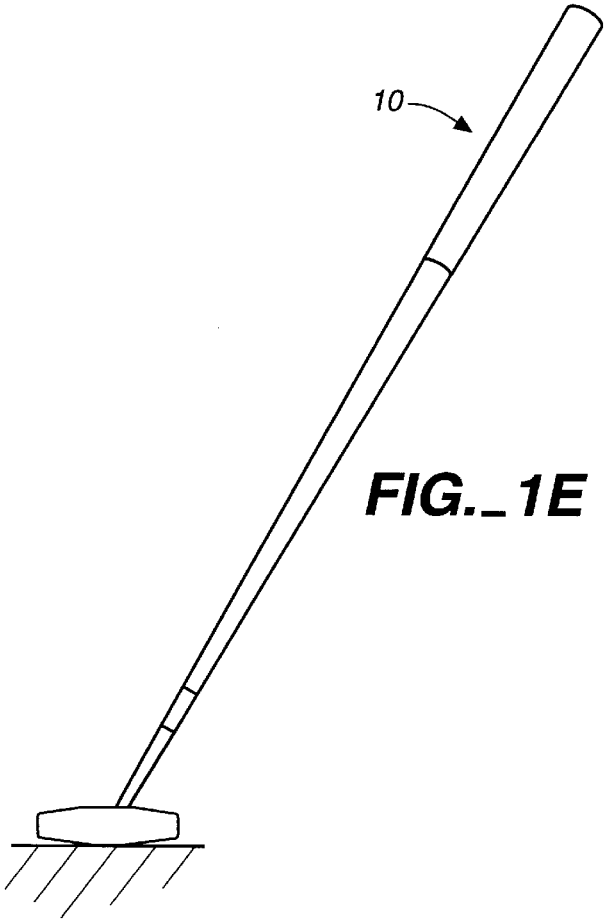
FIG._1E
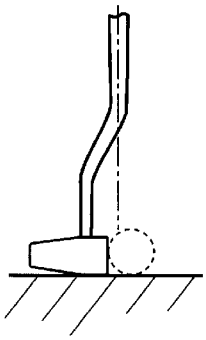
FIG._1C
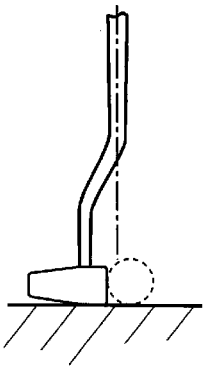
FIG._1D

GOLF PUTTER

FIELD OF THE INVENTION

The present invention generally relates to golf clubs, specifically golf putters.

BACKGROUND OF THE INVENTION

This invention is also the subject of a design, U.S. Pat. Des. No. 372,752, issued Aug. 13, 1996.

Golf clubs for putting have been used for many years. The major differences between putters and clubs used to strike the ball to obtain distance are as follows. First, the putter is generally shorter, not needing extra length to achieve higher club head speeds in the swing, the key to distance. Second, there is generally minimal loft to the putter face; the object being to send the ball rolling toward the hole. Third, putters will have varying heads and faces, typically to provide more feel, balance and "touch" for the golfer; the margin of error in striking the ball being influenced by a totally different swing, or stroke in the putting process.

Two acknowledged factors critical in putting are the ability to stroke the ball smoothly, and the ability to keep the ball on line; either through aim, execution of the take-away and downstroke, or compensation in the design of the club.

Since the advent of toe-heel balance, more attention has been paid to the enlargement of the "sweet spot", i.e., that area of the club face which minimizes error in the initial path of the ball off the face of the club when struck. Toe-heel balance works on the principle of maintaining more weight at the ends of the club face in order to provide a correctional component to the energy transmitted to the ball at impact, directing the ball back toward the path which would be achieved had the ball been struck in the center of the club face. Sweet spots also decrease the amount of twist in the club face felt by the golfer striking a ball off center. The reduction in twist and correction contributed by striking the ball in the sweet spot help give the golfer better feel with the shot. Better feel enables the golfer to judge more accurately the amount of energy he has imparted to the ball, thereby enabling the golfer to continue to more accurately strike the ball the desired distance to the hole, cutting strokes and lowering the final score.

With the increasing numbers of golfers, particularly those of novice or average skill, playing the game, putters with larger sweet spots, better feel and sensitivity are needed.

Like twist, vibration generated in the putter as a result of striking the ball is detrimental to putting feel. This results from the transfer of kinetic energy from the moving putter face to the stationary ball. After impact, a vibration resonates through the metallic material of the putter face and the body. There is a need for putters which eliminate vibration, thereby increasing the feel, and therefore the ability to achieve accuracy in putting.

Putter head designers also incorporate configurations focussed on preventing scuffing of the club on the putting surface during the stroke. Reducing this "blade turf drag" ensures a smooth path through the ball, enhancing the stroke. Providing good roll to the ball requires a smooth stroke, and demands a geometry of the putter head which propels the ball forward rather than up, or down into the putting surface. Innovative designs, with the objective of preventing the needless loss of strokes and improving roll are continually sought by golfers driven to better their scores.

SUMMARY OF THE INVENTION

A primary object of the present invention is to provide a putter head which reduces vibration, thereby increasing the feel of the stroke for the golfer. This is accomplished in the present invention by absorbing or dampening vibration resulting from striking the ball, thereby providing a smoother and more consistent transfer of energy, unencumbered by unrestrained vibration. Absorption is accomplished by use of an elastomeric material in contact with and slightly compressed between the putter face and the body of the putter. The putter face is rigidly mounted to the body at its ends only, with clearance between the putter face and the body behind the face center, the main ball striking area. The elastomeric material is placed behind the striking area of the face, under slight compression with the body and the face.

Another object of the present invention is to provide good roll to the struck ball. This is accomplished by providing more weight at the bottom of the back of the putter face, and by providing a double-bend shaft located as near to the center of impact as practical so that the center of rotation is located approximately with the line of impact, thereby reducing twist.

Yet another object of the present invention is to reduce blade turf drag by the incorporation of angles on the toe, heel and bottom of the putter body and face, minimizing any impediments which might result from swinging the putter flatly or in very close proximity to the putting surface. When the present invention is swept across the putting surface, a smooth, balanced feel is imparted to the golfer when striking the ball.

BRIEF DESCRIPTION OF THE DRAWINGS

FIG. 1 is a perspective view of the putter head.

FIG. 1A is a perspective view illustrating the putter head and double bent putter shaft.

FIGS. 1B, 1C and 1D are front elevational views which show various shaft positions, i.e. the centerline through the middle of the ball, slightly to the edge of the ball to be struck and aligned with the putter face.

FIG. 1E is a side elevational view of the putter and shaft showing the alignment of the shaft centerline.

FIG. 5 is a side elevational view of the face and body, showing the elastomeric material, the male portion of the face to body fit, as well as the angle incorporated into the bottom of the putter body.

FIG. 5A shows the assembly of FIG. 5.

DETAILED DESCRIPTION OF THE INVENTION

Figure 2:
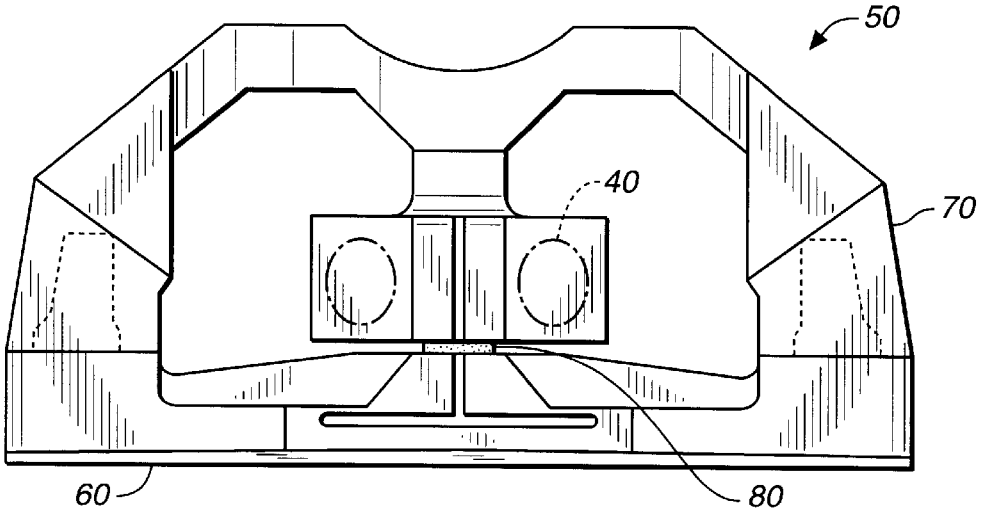
FIG. 2 is a plan view of the putter head showing the elastomeric material compressed between the putter face and body, and its relationship to the anvil and face.

The putter 10, is comprised of a shaft 100, inserted at hole 40 in the putter head 50 as shown in FIG. 1. The putter head 50, is made up of a face 60, and body, 70, also shown in the same figure. The materials currently employed in the face 60 are metallic, e.g., including but not limited to 17-4 stainless steel or aluminum bronze. The body is presently molded liquid crystal polymer. Suitable other materials may also be used to construct the elements of putter head 50.

A method of fastening the face 60, to the body is shown in FIG. 5, showing lug 62 which is press fit or glued into body 70 and used for weighting and balance purposes.

The structure of body 70 is further shown in FIG. 2, which also depicts the geometry of the body which transmits vibration back to an anvil 76, which has between it and face 60, one or more plugs of an elastomeric material 80, to absorb the redirected vibration.

Figure 3:
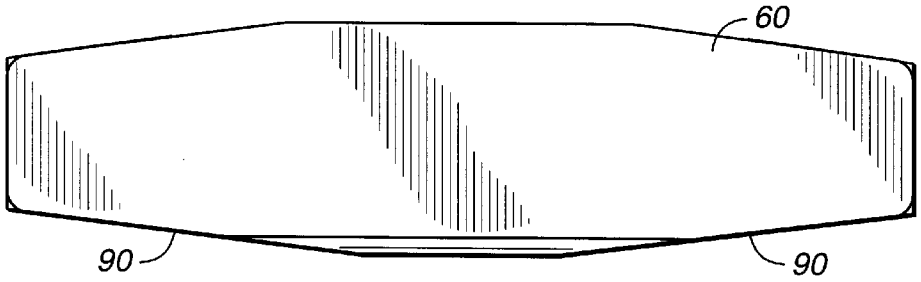
FIG. 3 is an elevational view of the putter face exterior.

The angular design of face 60 can be seen in FIG. 3, in bottom edge 90, rising away from the center of face 60 to prevent scuffing on the putting surface, or blade turf drag.

Figure 4:
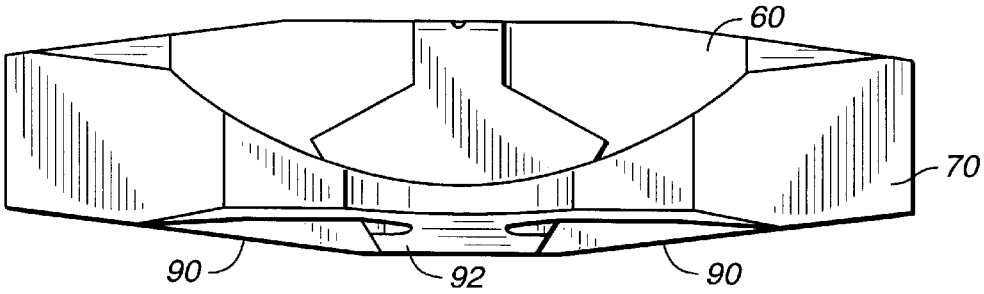
FIG. 4 is a rear elevational view of the putter head showing the angles incorporated into the putter body.
Figure 9:
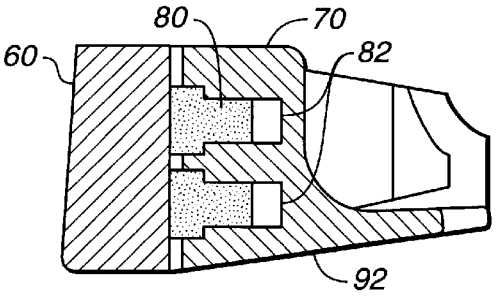
FIG. 9 is a cross section of the putter body taken at line 9 of FIG. 6.
Figure 9A:
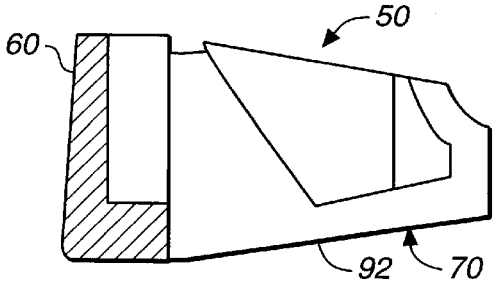
FIG. 9A is a plan view cross section of the putter body taken at line 9A of FIG. 6.

The corresponding angular design of body 70 can be seen in FIG. 4 and FIG. 9, by surface 92, rising as the surface extends toward the back of body 70. This configuration of molded liquid crystal polymer relocates the center of gravity higher than in traditional putters.

Figure 6:
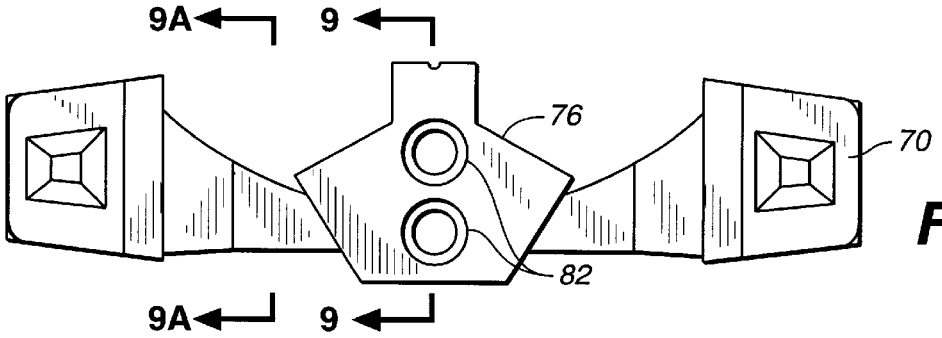
FIG. 6 is a front elevational view of the putter body without the face.
Figure 7:
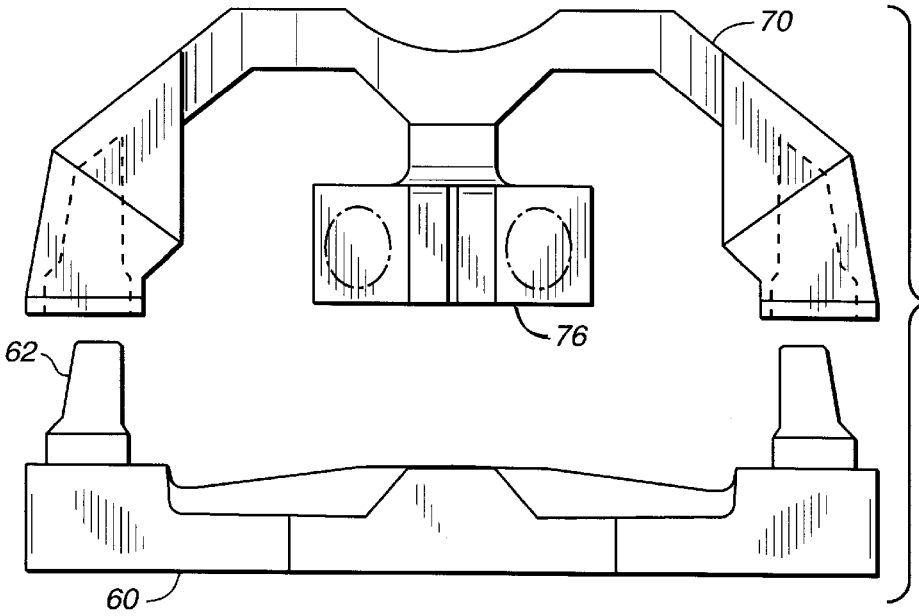
FIG. 7 is a top plan view of the putter face and body, detached from one another.

FIG. 6 shows the female fit 72 of body 70, and the geometry of anvil 76. The recesses 82 for plugs of elastomeric material 80 are located in anvil 76.

Figure 8:
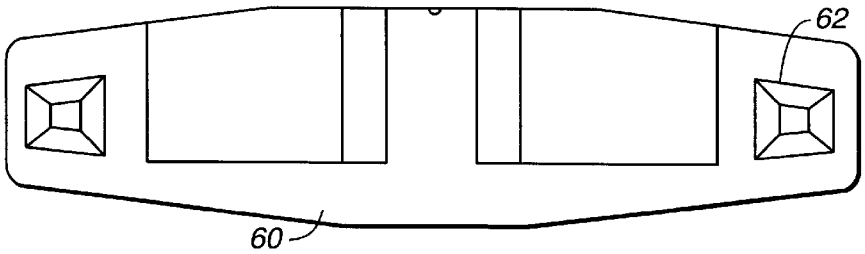
FIG. 8 is a rear elevational view of the putter face showing the lugs and the distribution of material away from the center of the face.

FIG. 8 shows the side of face 60 which mates with body 70, particularly showing the center surface which contacts the elastomeric material 80 of FIG. 2.

Figure 10:
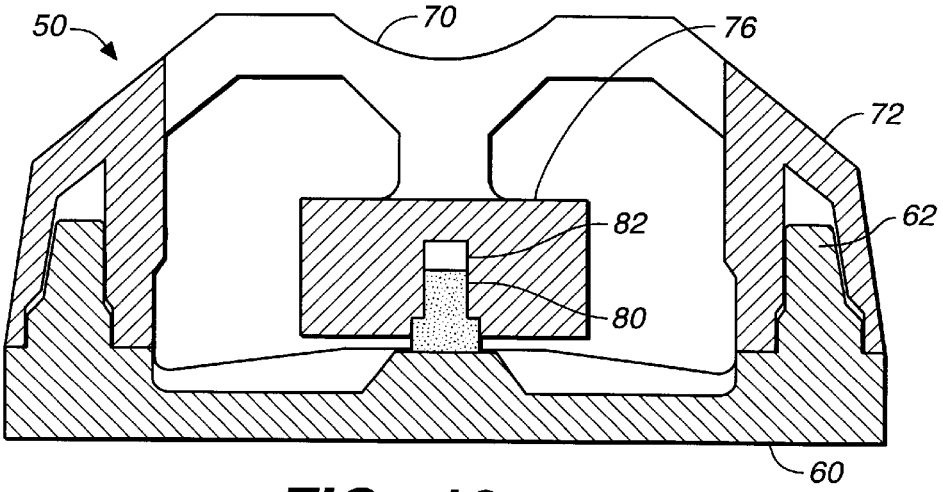
FIG. 10 is a bottom plan cross section of the putter body.

FIG. 10 depicts a cross section of FIG. 3, showing details of the mating scheme of face 60 to body 70 according to the present invention as well as the recess 82 in the anvil 76.

Figure 11:
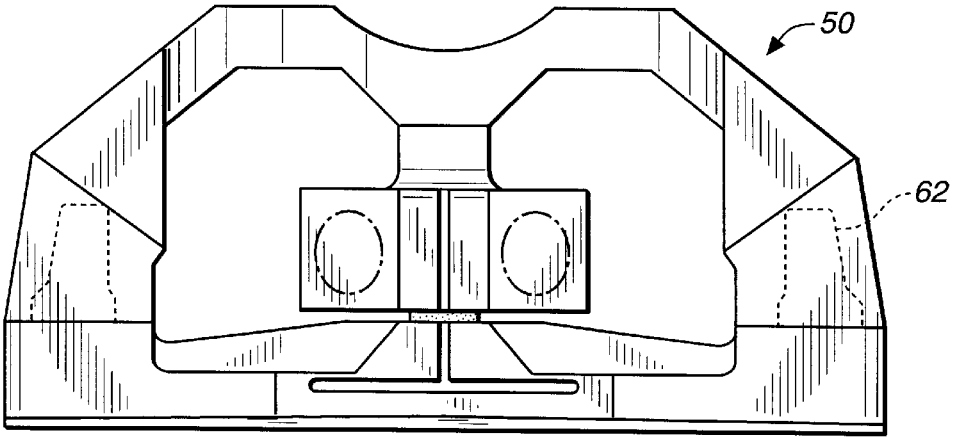
FIG. 11 is a top plan view of the putter body.

FIG. 11 shows the assembled putter head with dashed lines showing the final position of lugs 62.

Figure 12:
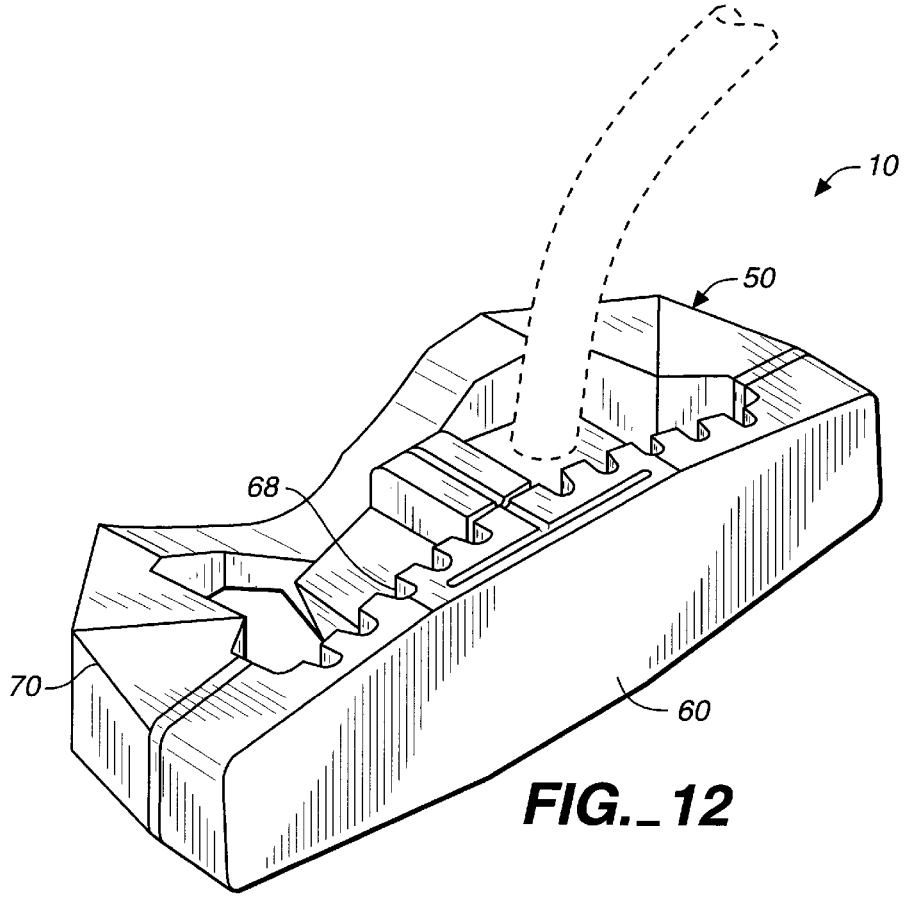
FIG. 12 is a front perspective view of the putter head embodiment employing vertical grooves on the rear of the putter face for weight distribution.

FIG. 12 shows an additional embodiment of the putter head 50 employing grooves 68 which are used for varying the weighting of the face.

Figure 13:
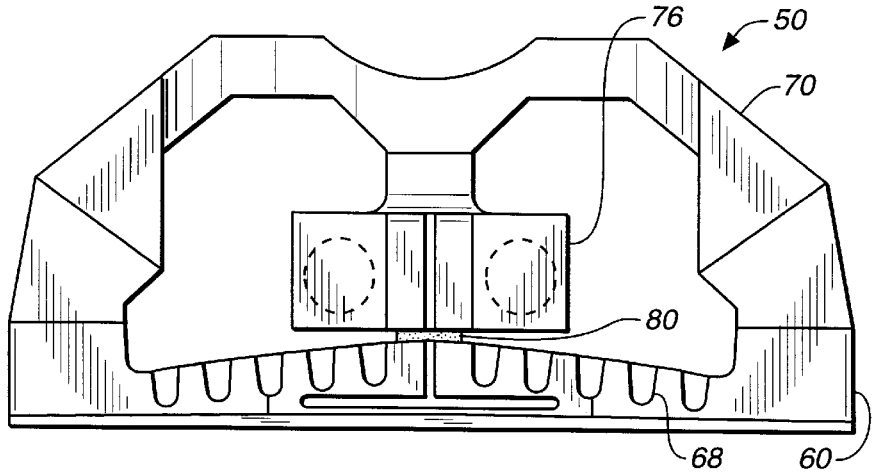
FIG. 13 is a top plan view of the putter head embodiment employing vertical grooves on the rear of the putter face for weight distribution.

FIG. 13 shows further the configuring of said grooves 68 and the relationship between said grooves and face 60.

Figure 14:
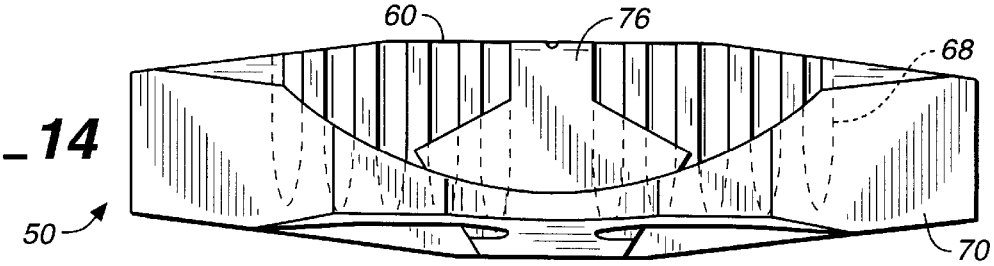
FIG. 14 is a rear elevational view of the putter head showing the angles of the body and the depth of the grooves in one embodiment of the invention.

FIG. 14 illustrates the typical depth of grooves 68 in this embodiment of the invention.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. An improved golf putter comprising:

a bottom-weighted face having two ends, a bottom edge and an upper edge having a "striking line" thereon;

a body having two arcuate segments extending away from and in a direction normal to said ends, said segments eventually extending toward each other and back toward said face, said segments joined at a location generally equidistant from said ends, said joined segments forming a surface parallel and proximate to the rear of said face, said body also having a central axis and a bottom surface;

fastening means between said ends and said segments;

a shaft having a longitudinal axis affixed to said body; and an elastomeric material compressed between said surface and said face such that when said putter strikes a golf ball, vibrations are directed along said segments and into said elastomeric material and said face where said vibrations are dampened and absorbed.

2. An improved putter as described in claim 1 wherein:

said shaft affixed to said putter body such that said shaft's longitudinal axis intersects said body's central axis coincident with said face's "striking line".

3. An improved putter as described in claim 1 wherein:

said fastening means comprises a male to female fit.

4. An improved putter as described in claim 1 wherein:

said face's bottom edge extending at an angle up and away from the center of said edge; and said body's bottom surface extending along said central axis at an angle up and away from said face's bottom edge.

5. An improved golf putter comprising:

A body having a bottom surface and a face with two ends, said face having an upper edge, a bottom edge, and a plurality of vertical grooves emanating from near said upper edge and gradually terminating near said bottom edge;

said body further comprising two arcuate segments extending away from and in a direction normal to said ends, said segments eventually extending toward each other and back toward said face, said segments joined at a location generally equidistant from said ends, said joined segments forming a surface parallel and proximate to the rear of said face;

fastening means between said ends and said segments;

a shaft having a longitudinal axis affixed to said putter; and an elastomeric material compressed between said surface and said face such that when said putter strikes a golf ball, vibrations are directed along said segments into said elastomeric material and said face where said vibrations are dampened and absorbed.

6. An improved putter as described in claim 5, wherein:

said body having a central axis;

said longitudinal axis intersecting said central axis.

7. An improved putter as described in claim 5 wherein:

said fastening means comprises a male to female fit.

8. An improved putter as described in claim 5 wherein said body having central axis:

said face's bottom edge extending along said central axis at an angle up and away from the center of said edge; and said body's bottom surface extending at an angle up and away from said face's bottom edge.

9. An improved golf putter comprising:

a body shaped generally in a "w" having a central axis, said body having two outer ends with female fastening means and an anvil between said ends at the inboard middle of said "w" shape, said body having a bottom surface extending along said central axis at an angle upward and away from said outer ends;

a bottom-weighted face having two ends with male fastening means, a bottom edge and an upper edge having a "striking line" thereon, said face also having a center area of predetermined width disposed flat in parallel registry with said anvil, said bottom edge extending at an angle upward and away from the center of said bottom edge;

said body and said face joined by fixing said male fastening means inside said female fastening means;

a shaft having a longitudinal axis, said longitudinal axis aligned parallel to said face, said shaft offset from said face and affixed to said body at said anvil;

an elastomeric material compressed between said anvil and said face such that when said putter strikes a golf ball, vibrations are directed along said segments and into said elastomeric material and said face where said vibrations are dampened and absorbed.

10. An improved golf putter as described in claim 9 wherein:

said anvil forming a bore for affixing said shaft therein.

* * * * *